US008247069B2

(12) United States Patent
Kalayci

(10) Patent No.: US 8,247,069 B2
(45) Date of Patent: Aug. 21, 2012

(54) POLYMER BLEND, POLYMER SOLUTION COMPOSITION AND FIBERS SPUN FROM THE POLYMER BLEND AND FILTRATION APPLICATIONS THEREOF

(75) Inventor: Veli Kalayci, Farmington, MN (US)

(73) Assignee: Donaldson Company, Inc., Minneapolis, MN (US)

( * ) Notice: Subject to any disclaimer, the term of this patent is extended or adjusted under 35 U.S.C. 154(b) by 0 days.

(21) Appl. No.: 13/116,355

(22) Filed: May 26, 2011

(65) Prior Publication Data

US 2011/0226690 A1 Sep. 22, 2011

Related U.S. Application Data

(62) Division of application No. 11/703,490, filed on Feb. 7, 2007, now Pat. No. 7,981,509.

(60) Provisional application No. 60/773,227, filed on Feb. 13, 2006.

(51) Int. Cl.
*D02G 3/00* (2006.01)
*C08F 283/04* (2006.01)

(52) U.S. Cl. ..... 428/364; 428/359; 525/424

(58) Field of Classification Search ..... 428/359, 428/364, 373, 374, 221, 357; 525/424; 55/482, 55/488, 486, 487, 498, 502, 503, 521, 527, 55/528; 96/134, 135, 153, 154; 210/502.1; 442/340, 341, 344, 392, 403

See application file for complete search history.

(56) References Cited

U.S. PATENT DOCUMENTS 3,676,242 A 7/1972 Prentice
3,841,953 A 10/1974 Lohkamp et al.
3,849,241 A 11/1974 Butin et al.
3,878,014 A 4/1975 Melead
4,650,506 A 3/1987 Barris et al.
5,047,456 A 9/1991 Onwumere et al.
5,061,425 A 10/1991 Ito et al.
5,164,262 A 11/1992 Kobayashi et al.
5,423,892 A 6/1995 Kahlbaugh et al.
5,973,013 A 10/1999 Igwe
6,197,915 B1 3/2001 Yamana et al.
6,547,858 B1 4/2003 Edlund et al.
6,673,136 B2 1/2004 Gillingham et al.
6,743,273 B2 6/2004 Chung et al.

(Continued)

FOREIGN PATENT DOCUMENTS

JP 2000017041 1/2000

(Continued)

OTHER PUBLICATIONS

Office Action dated May 11, 2010 in co-pending Chinese Patent Application No. 200780006850.0, filed Feb. 7, 2007 (6 pages).

(Continued)

*Primary Examiner* — Elizabeth Cole
*Assistant Examiner* — Altrev Sykes
(74) *Attorney, Agent, or Firm* — Pauly, DeVries Smith & Deffner, L.L.C.

(57) ABSTRACT

The invention relates to a web or filter structure such as the filtration media comprising a collection of fiber comprising a first polymer and a second polymer in a fine fiber or fine fiber web structure. The combination of two polymers provides improved fiber rheology in that the fiber has excellent temperature and mechanical stability. The combination of polymers imparts the properties of elasticity or tackiness, which is desirable for adhering particles to the fiber web, with high temperature resistance.

17 Claims, 7 Drawing Sheets

U.S. PATENT DOCUMENTS

| | | | |
|---|---|---|---|
| 6,800,117 | B2 | 10/2004 | Barris et al. |
| 6,924,028 | B2 | 8/2005 | Chung et al. |
| 6,955,775 | B2 | 10/2005 | Chung et al. |
| 7,018,438 | B2 | 3/2006 | Duggan |
| 7,070,640 | B2 | 7/2006 | Chung et al. |
| 7,090,715 | B2 | 8/2006 | Chung et al. |
| 7,179,317 | B2 | 2/2007 | Chung et al. |
| 7,390,760 | B1 | 6/2008 | Chen et al. |
| 7,494,533 | B2 | 2/2009 | Giacobbe |
| 2006/0069111 | A1 | 3/2006 | Carroll |
| 2006/0094320 | A1 | 5/2006 | Chen et al. |
| 2007/0237947 | A1 | 10/2007 | Gleason et al. |
| 2007/0248827 | A1 | 10/2007 | Rukavina et al. |
| 2008/0160856 | A1 | 7/2008 | Chen et al. |

FOREIGN PATENT DOCUMENTS

| | | | |
|---|---|---|---|
| JP | 2001514296 | | 9/2001 |
| JP | 2004508164 | | 3/2004 |
| WO | WO 92/01094 | | 1/1991 |
| WO | WO 02/20132 | A2 | 3/2002 |
| WO | WO 02/20668 | A2 | 3/2002 |
| WO | WO-0220129 | | 3/2002 |
| WO | WO-0220132 | | 3/2002 |
| WO | WO 2005/064048 | A1 | 7/2005 |
| WO | WO 2005/073441 | A1 | 8/2005 |
| WO | WO-2007095219 | | 8/2007 |

OTHER PUBLICATIONS

Material Safety Data Sheet, Noveon, 15 pages (Date Printed Jan. 30, 2006).

*Nylon Plastics Handbook*, edited by M. Kohan, pp. 284-287 (1995).

Siefken, V., "Mono- und Polyisocyanate IV. Mitteilung über Polyurethane," *Justus Liebigs Annalen der Chemie*, vol. 562, pp. 75-136 (1949).

Waltz, J. et al., "Determination of the Molecular Weight of Nylon," *Industrial and Engineering Chemistry, Analytical Chemistry*, vol. 19, No. 7, pp. 448-480 (Jul. 1947).

File history for co-pending U.S. Appl. No. 11/703,490, filed Feb. 7, 2007, entitled "Polymer Blend, Polymer Solution Composition and Fibers Spun From the Polymer Blend and Filtration Applications Thereof" (230 pages).

"First Office Action", for Japanese Application No. 2008-554422, corresponding to U.S. Appl. No. 11/703,490, mailed Sep. 30, 2011, (pp. 9) Including English translation.

"Third Office Action", from Chinese Application No. 200780006850.0, corresponding to U.S. Appl. No. 13/116,355 mailed Apr. 12, 2012 (pp. 1-3).

POLYMER BLEND, POLYMER SOLUTION COMPOSITION AND FIBERS SPUN FROM THE POLYMER BLEND AND FILTRATION APPLICATIONS THEREOF

RELATED APPLICATION

This application is a divisional application of U.S. patent application Ser. No. 11/703,490, filed Feb. 7, 2007, which issued as U.S. Pat. No. 7,981,509 on Jul. 19, 2011, which claims priority under 35 U.S.C. §119(e) to U.S. provisional application Ser. No. 60/773,227 filed on Feb. 13, 2006, incorporated by reference herein.

FIELD OF THE INVENTION

The invention relates to a web or filter structure such as the filtration media comprising a collection of fiber comprising a first polymer and a second polymer in a fine fiber or fine fiber web structure. The combination of two polymers provides to the resulting fine fiber filter media or filter structure, improved fiber rheology in that the fiber has excellent temperature stability and resistance and mechanical stability. Such fiber can be made for use in a filter media having excellent Figure of Merit, filtration efficiency, permeability and lifetime.

BACKGROUND OF THE INVENTION

Fluid streams comprise a mobile phase and an entrained particle or particulate. Such streams are often combined or contaminated with substantial proportions of one or more liquid or solid particulate materials. These contaminant materials can vary in composition, particle size, particle morphology, density or other physical parameters. The fluid may be air, and air streams can be filtered in intake streams in the cabins of motorized vehicles, air in computer disk drives, HVAC air clean room ventilation and applications using filter bags, barrier fabrics, woven materials, air to engines for motorized vehicles or for power generation. Alternatively, filtration can be employed for gas streams directed to gas turbines or air streams used in a variety of combustion furnaces.

Polymer webs have been made by electrospinning, extrusion melt spinning, air laid processes or wet laid processing. The manufacture of filter structures from filter media is well known and has been practiced for many years. The filtration efficiency of such filters is characteristic of the filtration media and is related to the fraction of the particulate removed from the mobile fluid stream. Efficiency is typically measured by a set test protocol, an example of which is defined below. Fine fiber technologies that contemplate polymeric materials blended with a variety of other substances is disclosed in Chung et al., U.S. Pat. No. 6,743,273; Chung et al., U.S. Pat. No. 6,924,028; Chung et al., U.S. Pat. No. 6,955,775; Chung et al., U.S. Pat. No. 7,070,640; Chung et al., U.S. Pat. No. 7,090,715; Chung et al., U.S. Patent Publication No. 2003/0106294; Barris et al., U.S. Pat. No. 6,800,117; and Gillingham et al., U.S. Pat. No. 6,673,136. Additionally, in copending U.S. Ser. No. 11/272,492 filed 10 Nov. 2005, a water insoluble, high strength polymer material is made by blending a polysulfone polymer with a polyvinylpyrrolidone polymer resulting in a single phase polymer alloy used in electrospinning fine fiber materials. While the fine fiber materials discussed above have adequate performance for a number of filtration end uses, in applications with extremes of temperature ranges, where mechanical stability is required, improvements in fiber properties can always be made.

SUMMARY OF THE INVENTION

The invention relates to a fine fiber, a fine fiber layer, a fine fiber web or the use of such structures in a filter media element or cartridge. Such a media can be used in a filter structure. The fine fiber comprising a polyurethane polymer, often a thermoplastic polyurethane (TPU) and a second polymer. A vast array of polyurethane polymers can be made by reacting a polyfunctional isocyanate compound with a polymer forming unit having at least two reactive hydrogens. The preferred polymer blend in a combination of a polyurethane and a polyamide or a nylon polymer. The nylon polymer can be nylon 6, nylon 6,6 or other complex or crosslinked nylon polymers.

Fiber in the form of a layer, web or medium can be applied to a variety of end uses including filtration technology. The fiber can be used in a filter or filter structure wherein the fine fiber layers and the fiber materials are used in filter structures and methods of filtering fluids such as air, gas and liquid streams. Nanofiber filter media have fueled new levels of performance in air filtration in commercial, industrial and defense applications and have extended the use in the usability of nanofibers into applications requiring an array of filtration properties such as high temperature stability, mechanical stability, high efficiency, high permeability and long lifetime. We have found nanofiber, nanofiber webs, nanofiber matrices and webs that provide high filtration efficiency compared to existing structures with improved temperature and mechanical stability.

The fine fiber, fiber layer web or media can comprise a substantially continuous fiber or fiber mass comprising a first thermoplastic polymer and a second polyurethane polymer. One aspect of the web comprises a continuous fiber structure with a substantially continuous fiber media web. The web using the novel polymeric blend of the invention can be used in filtration applications and a variety of filter types. For example, the material can be used as a depth media, as a conventional fiber media layer, and can obtain an improved Figure of Merit, filtration efficiency, filtration permeability, depth loading and extended useful lifetime characterized by minimal pressure drop increase. Lastly, an important aspect of the invention involves forming the spun layer in a complete finished web or thickness and then adding the web or thickness with or without a substrate layer into additional components forming a useful article. Subsequent processing including lamination, calendaring, compression or other processes can incorporate the fiber or fiber web into a useful filter structure. The fiber or fiber web of the invention can be used in the form of a single fine fiber web or a series of fine fiber webs in a laminated filter structure.

The term "fine fiber" indicates a fiber having a fiber size or diameter of 0.001 to less than 5 microns or about 0.001 to less than 2 microns and often, in some instances, 0.001 to 0.5 micron. A variety of methods can be used for the electrospinning, melt blowing or other fiber manufacture. Chen et al., U.S. Pat. No. 6,743,273; Kahlbaugh et al., U.S. Pat. No. 5,423,892; McLead, U.S. Pat. No. 3,878,014; Barris, U.S. Pat. No. 4,650,506; Prentice, U.S. Pat. No. 3,676,242; Lohkamp et al., U.S. Pat. No. 3,841,953 and Butin et al., U.S. Pat. No. 3,849,241; all of which are incorporated by reference herein, disclose a variety of fine fiber technologies.

The fine fiber of the invention is typically manufactured by blending two distinct polymer types. The polymers can be blended in any useful way including melt blending coextrusion, etc., the polymers can also be blended in a compatible solution. The solution acts as a compatibilizer for the polymer materials. In solution, many types of polymers that can be incompatible in a polymer alloy or mixture, such that they may form separate phases under melt conditions, can be made to be compatibilized in the presence of a solvent. The fine fiber materials from the solvent can be spun using a variety of techniques into useful fiber. Even though polymer types may be somewhat incompatible, the melt phase melt spinning or electrospinning from the solvent phase can improve the compatibility of the polymer material such that they can form a stable fiber after formation and drying of the compatibilizing solvent material.

The fine fiber of the invention can be electrospun onto a substrate from the solvent. The substrate can be pervious or impervious material. In filtration applications, non-woven filter media can be used as a substrate. In other applications, the fiber can be spun onto an impervious layer and then can be removed for downstream processing. In such applications, the fiber can be spun onto a metal drum or foil. The fine fiber layers formed on the substrate and the filters of the invention can be substantially uniform in particulate distribution, filtering performance, and fiber distribution. By substantial uniformity, we mean the fiber has sufficient coverage over the substrate to have at least some measurable filtration efficiency throughout the surface of the covered substrate. The media of the invention can be used in laminates with multiple webs in a filter structure. The media of the invention includes at least one web of the fine fiber structure, the layers can also have a gradient of particulate in a single layer or in a series of layers in a laminate.

For the purpose of this invention, the term "media" includes a structure comprising a web comprising a substantially continuous fine fiber web or mass and the separation or spacer materials of the invention dispersed in the fiber web, mass or layer. In this disclosure, the term "web" includes a substantially continuous or contiguous fine fiber phase with a dispersed spacer particulate phase substantially within the fiber. A continuous web is necessary to impose a barrier to the passage of a particulate contaminant loading in a mobile phase. A single web, two webs or multiple webs can be combined to make up the single layer or laminate filter media of the invention.

BRIEF DESCRIPTION OF THE FIGURES

FIG. 2 shows the fiber of FIG. 1, after heating. The fibers have melted and coalesced.

DETAILED DISCUSSION OF THE INVENTION

Figure 1:
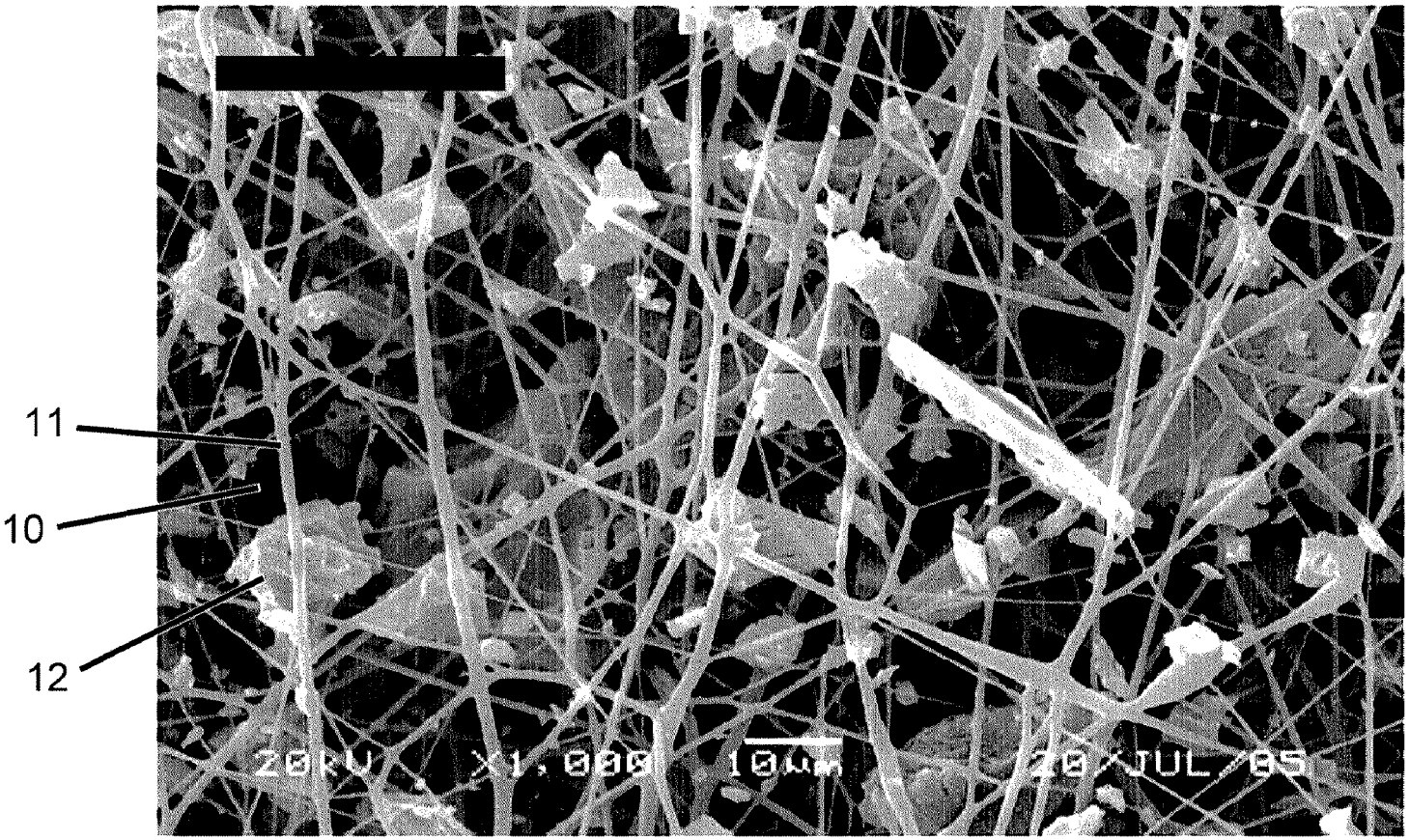
FIGS. 1 and 2 represent SEM or scanning electron micrographs of polyurethane (TPU) fine fiber having carbon particles entrained in the fiber web.

The fine fiber of the invention comprises a fiber of nanofiber size comprising a polyurethane polymer and a second polymer. In the context of this disclosure, the term "second polymer" connotes a polymer different than the polyurethane polymer. A different polymer in this context can imply a different polyurethane in that the polyurethane comprises a different di-, tri- or polyfunctional isocyanate reactant or a different polymer forming unit with an active hydrogen such as a hard or soft polyol reactant in the manufacture of the polyurethane, can connote a substantially different polyurethane in molecular weight. The term can also connote a different polymer type such as a polyolefin, polyvinylchloride, polyvinylalcohol, nylon, aramide, acrylate or other polymer type than differ substantially in molecular weight, monomer type or compatibility. The combination of polymers is achieved through spinning the polymer blend from solvent.

In the fiber of the invention, the fiber can contain about 10 to 90 wt %, preferably about 90 to 80 wt % of the polyurethane polymer, the balance about 90 to 10 wt %, preferably about 80 to about 20 wt % of the second distinct polymer type. In one embodiment the polymer can be blended in an amount 45 to 55 wt % of the TPU and 55% wt % of the second polymer. Due to the nature of the manufacture of the fiber, the fiber can exist as a true solution of the polymers, one in the other, or can have dispersed regions of the fiber wherein each of the polymer is the substantial contents of the region resulting in a fiber containing polymer regions and strands within the fiber structure. Typically, the fibers of the invention do not contain a polymer alloy, but do contain the polymers in an intermittently contacted, but typically discontinuous, internal structure. However, certain polymers are known to form true polymer alloys that are typically connoted by a single TGA scan.

The overall thickness of the fiber web is about 1 to 100 times the fiber diameter or about 1 to 300 microns or about 5 to 200 microns. The overall solidity (including the contribution of the separation means) of the media is about 0.1 to about 50%, preferably about 1 to about 30%. The combined polymer fiber of the invention can attain a filtration efficiency of about 40 to about 99.99% when measured according to ASTM-1215-89, with 0.78μ monodisperse polystyrene spherical particles, at 13.21 fpm (4 meters/min) as described herein. The Figure of Merit can range from 100 to $10^5$. The filtration web of the invention typically exhibits a Frazier permeability test that would exhibit a permeability of at least about 1 meters-minutes$^{-1}$, preferably about 5 to about 50 meters-minutes$^{-1}$ The polyurethane (TPU) used in this invention can be an aliphatic or aromatic polyurethane depending on the isocyanate used and can be a polyether polyurethane or a polyester polyurethane. A polyether urethane having good physical properties can be prepared by melt polymerization of a hydroxyl-terminated polyether or polyester intermediate and a chain extender with an aliphatic, aromatic, or polymeric diisocyanate. The hydroxyl-terminated polyether has alkylene oxide repeat units containing from 2 to 10 carbon atoms and has a weight average molecular weight of at least 1000. The chain extender is a substantially non-branched glycol having 2 to 20 carbon atoms. The amount of the chain extender is from 0.5 to less than 2 mole per mole of hydroxyl terminated polyether. It is preferred that the polyether polyurethane have a melting point of about 140° C. to 250° C. or greater (e.g., 150° C. to 250° C.) with 180° C. or greater being preferred.

In a first mode, the polyurethane polymer of the invention can be made simply by combining a di-, tri- or higher functionality aromatic or aliphatic isocyanate compound with a polyol compound that can comprise either a polyester polyol or a polyether polyol. The reaction between the active hydrogen atoms in the polyol with the isocyanate groups forms the addition polyurethane polymer material in a straight forward fashion. Typically, the OH:NCO ratio is typically about 0.8:1 to 2:1, with post reaction treatments leaving little or no unreacted isocyanate in the finished polymer unreacted isocyanate compound, reactivity can be scavenged using isocyanate reactive compounds. In a second mode, the polyurethane polymer can be synthesized in a stepwise fashion from isocyanate terminated prepolymer materials. The polyurethane can be made for an isocyanate-terminated polyether or polyester. An isocyanate-capped polyol prepolymer can be chain-extended with an aromatic or aliphatic dihydroxy compound. The term "isocyanate-terminated polyether or polyurethane" refers generally to a prepolymer which comprises a polyol that has been reacted with a diisocyanate compound (i.e., a compound containing at least two isocyanate (—NCO) groups). In preferred form, the prepolymer has a functionality of 2.0 or greater, an average molecular weight of about 250 to 10,000 or 600-5000, and is prepared so as to contain substantially no unreacted monomeric isocyanate compound. The term "unreacted isocyanate compound" refers to free monomeric aliphatic or aromatic isocyanate-containing compound, i.e., diisocyanate compound which is employed as a starting material in connection with the preparation of the prepolymer and which remains unreacted in the prepolymer composition.

The term "polyol" as used herein, generally refers to a polymeric compound having more than one hydroxy (—OH) group, preferably an aliphatic polymeric (polyether or polyester) compound which is terminated at each end with a hydroxy group. The chain-lengthening agents are difunctional and/or trifunctional compounds having molecular weights of from 62 to 500 preferably aliphatic diols having from 2 to 14 carbon atoms, such as, for example, ethanediol, 1,6-hexanediol, diethylene glycol, dipropylene glycol and, especially, 1,4-butanediol. Also suitable, however, are diesters of terephthalic acid with glycols having from 2 to 4 carbon atoms, such as, for example, terephthalic acid bis-ethylene glycol or 1,4-butanediol, hydroxy alkylene ethers of hydroquinone, such as, for example, 1,4-di(.beta.-hydroxyethyl)-hydroquinone, (cyclo)aliphatic diamines, such as, for example, isophorone-diamine, ethylenediamine, 1,2-, 1,3-propylene-diamine, N-methyl-1,3-propylene-diamine, N,N'-dimethyl-ethylene-diamine, and aromatic diamines, such as, for example, 2,4- and 2,6-toluoylene-diamine, 3,5-diethyl-2,4- and/or -2,6-toluoylene-diamine, and primary ortho- di-, tri- and/or tetra-alkyl-substituted 4,4'-diaminodiphenyl-methanes. It is also possible to use mixtures of the above-mentioned chain-lengthening agents. Preferred polyols are polyesters, polyethers, polycarbonates or a mixture thereof. A wide variety of polyol compounds is available for use in the preparation of the prepolymer. In preferred embodiments, the polyol may comprise a polymeric diol including, for example, polyether diols and polyester diols and mixtures or copolymers thereof. Preferred polymeric diols are polyether diols, with polyalkylene ether diols being more preferred. Exemplary polyalkylene polyether diols include, for example, polyethylene ether glycol, polypropylene ether glycol, polytetramethylene ether glycol (PTMEG) and polyhexamethylene ether glycol and mixtures or copolymers thereof. Preferred among these polyalkylene ether diols is PTMEG. Preferred among the polyester diols are, for example, polybutylene adipate glycol and polyethylene adipate glycol and mixtures or copolymers thereof. Other polyether polyols may be prepared by reacting one or more alkylene oxides having from 2 to 4 carbon atoms in the alkylene radical with a starter molecule containing two active hydrogen atoms bonded therein. The following may be mentioned as examples of alkylene oxides: ethylene oxide, 1,2-propylene oxide, epichlorohydrin and 1,2- and 2,3-butylene oxide. Preference is given to the use of ethylene oxide, propylene oxide and mixtures of 1,2-propylene oxide and ethylene oxide. The alkylene oxides may be used individually, alternately in succession, or in the form of mixtures. Starter molecules include, for example: water, amino alcohols, such as N-alkyldiethanolamines, for example N-methyl-diethanolamine, and diols, such as ethylene glycol, 1,3-propylene glycol, 1,4-butanediol and 1,6-hexanediol. It is also possible to use mixtures of starter molecules. Suitable polyether polyols are also the hydroxyl-group-containing polymerization products of tetrahydrofuran. Suitable polyester polyols may be prepared, for example, from dicarboxylic acids having from 2 to 12 carbon atoms, preferably from 4 to 6 carbon atoms, and polyhydric alcohols. Suitable dicarboxylic acids include, for example: aliphatic dicarboxylic acids, such as succinic acid, glutaric acid, adipic acid, suberic acid, azelaic acid and sebacic acid, and aromatic dicarboxylic acids, such as phthalic acid, isophthalic acid and terephthalic acid. The dicarboxylic acids may be used individually or in the form of mixtures, for example in the form of a succinic, glutaric and adipic acid mixture. It may be advantageous for the preparation of the polyester polyols to use instead of the dicarboxylic acids the corresponding dicarboxylic acid derivatives, such as carboxylic acid diesters having from 1 to 4 carbon atoms in the alcohol radical, carboxylic acid anhydrides or carboxylic acid chlorides. Examples of polyhydric alcohols are glycols having from 2 to 10, preferably from 2 to 6, carbon atoms, such as ethylene glycol, diethylene glycol, 1,4-butanediol, 1,5-pentanediol, 1,6-hexanediol, 1,10-decanediol, 2,2-dimethyl-1,3-propanediol, 1,3-propanediol and dipropylene glycol. According to the desired properties, the polyhydric alcohols may be used alone or, optionally, in admixture with one another. Also suitable are esters of carbonic acid with the mentioned diols, especially those having from 4 to 6 carbon atoms, such as 1,4-butanediol and/or 1,6-hexanediol, condensation products of (omega.-hydroxycarboxylic acids, for example (omega.-hydroxycaproic acid, and preferably polymerization products of lactones, for example optionally substituted (epsilon.-caprolactones. There are preferably used as polyester polyols ethanediol polyadipate, 1,4-butanediol polyadipate, ethanediol-1,4-butanediol polyadipate, 1,6-hexanediol neopentyl glycol polyadipate, 1,6-hexanediol-1,4-butanediol polyadipate and polycaprolactones. The polyester polyols have molecular weights of from 600 to 5000.

The number average molecular weight of the polyols from which the polymer or prepolymers may be derived may range from about 800 to about 3500 and all combinations and subcombinations of ranges therein. More preferably, the number average molecular weights of the polyol may range from about 1500 to about 2500, with number average molecular weights of about 2000 being even more preferred.

The polyol in the prepolymers can be capped with an isocyanate compound or can be fully reacted to the thermoplastic polyurethane (TPU). A wide variety of diisocyanate compounds is available for use in the preparation of the prepolymers of the present invention. Generally speaking, the diisocyanate compound may be aromatic or aliphatic, with aromatic diisocyanate compounds being preferred. Included among the suitable organic diisocyanates are, for example, aliphatic, cycloaliphatic, araliphatic, heterocyclic and aromatic diisocyanates, as are described, for example, in Justus Liebigs *Annalen der Chemie,* 562, pages 75 to 136. Examples of suitable aromatic diisocyanate compounds include diphenylmethane diisocyanate, xylene diisocyanate, toluene diisocyanate, phenylene diisocyanate, and naphthalene diisocyanate and mixtures thereof. Examples of suitable aliphatic diisocyanate compounds include dicyclohexylmethane diisocyanate and hexamethylene diisocyanate and mixtures thereof. Preferred among the diisocyanate compounds is MDI due, at least in part, to its general commercial availability and high degree of safety, as well as its generally desirable reactivity with chain extenders (discussed more fully hereinafter). Other diisocyanate compounds, in addition to those exemplified above, would be readily apparent to one of ordinary skill in the art, once armed with the present disclosure. The following may be mentioned as specific examples: aliphatic diisocyanates, such as hexamethylene diisocyanate, cycloaliphatic diisocyanates, such as isophorone diisocyanate, 1,4-cyclohexane diisocyanate, 1-methyl-2,4- and -2,6-cyclohexane diisocyanate and the corresponding isomeric mixtures, 4,4'-, 2,4'- and 2,2'-dicyclohexylmethane diisocyanate and the corresponding isomeric mixtures, and, preferably, aromatic diisocyanates, such as 2,4-toluoylene diisocyanate, mixtures of 2,4- and 2,6-toluoylene diisocyanate, 4,4'-, 2,4'- and 2,2'-diphenylmethane diisocyanate, mixtures of 2,4'- and 4,4'-diphenylmethane diisocyanate, urethane-modified liquid 4,4'- and/or 2,4'-diphenylmethane diisocyanates, 4,4'-diisocyanatodiphenylethane-(1,2) and 1,5-naphthylene diisocyanate. Preference is given to the use of 1,6-hexamethylene diisocyanate, isophorone diisocyanate, dicyclohexylmethane diisocyanate, diphenylmethane diisocyanate isomeric mixtures having a 4,4'-diphenylmethane diisocyanate content of greater than 96 wt. %, and especially 4,4'-diphenylmethane diisocyanate and 1,5-naphthylene diisocyanate.

For the preparation of the TPUs, the chain-extension components are reacted, optionally in the presence of catalysts, auxiliary substances and/or additives, in such amounts that the equivalence ratio of NCO groups to the sum of all the NCO-reactive groups, especially of the OH groups of the low molecular weight diols/triols and polyols, is from 0.9:1.0 to 1.2:1.0, preferably from 0.95:1.0 to 1.1:1.0. Suitable catalysts, which in particular accelerate the reaction between the NCO groups of the diisocyanates and the hydroxyl groups of the diol components, are the conventional tertiary amines known in the prior art, such as, for example, triethylamine, dimethylcyclohexylamine, N-methylmorpholine, N,N'-dimethyl-piperazine, 2-(dimethylaminoethoxy)-ethanol, diazabicyclo-(2,2,2)-octane and the like, as well as, especially, organometallic compounds such as titanic acid esters, iron compounds, tin compounds, for example tin diacetate, tin dioctate, tin dilaurate or the tindialkyl salts of aliphatic carboxylic acids, such as dibutyltin diacetate, dibutyltin dilaurate or the like. The catalysts are usually used in amounts of from 0.0005 to 0.1 part per 100 parts of polyhydroxy compound. In addition to catalysts, auxiliary substances and/or additives may also be incorporated into the chain-extension components. Examples which may be mentioned are lubricants, antiblocking agents, inhibitors, stabilizers against hydrolysis, light, heat and discoloration, flameproofing agents, colorings, pigments, inorganic and/or organic fillers and reinforcing agents. Reinforcing agents are especially fibrous reinforcing materials such as, for example, inorganic fibers, which are prepared according to the prior art and may also be provided with a size.

Further additional components that may be incorporated into the TPU are thermoplastics, for example PVC, polypropylene and other polyolefin, polycarbonates and acrylonitrile-butadiene-styrene terpolymers (ABS). ABS is particularly preferred. Other elastomers, such as, for example, rubber, ethylene-vinyl acetate polymers, polyvinylalcohol, styrene-butadiene copolymers and other TPUs, may likewise be used. Also suitable for incorporation are commercially available plasticizers such as, for example, phosphates, phthalates, adipates, sebacates. The TPU's according to the invention may be produced continuously. Either the known band process or the extruder process may be used. The components may be metered simultaneously, i.e. one shot, or in succession, i.e. by a prepolymer process. In that case, the prepolymer may be introduced either batchwise or continuously in the first part of the extruder, or it may be prepared in a separate prepolymer apparatus arranged upstream. The extruder process is preferably used, optionally in conjunction with a prepolymer reactor.

Polymer materials that can be used as the second polymer compositions of the invention include both addition polymer and condensation polymer materials such as polyolefin, polyacetal, polyamide, polyester, cellulose ether and ester, polyalkylene sulfide, polyarylene oxide, polysulfone, modified polysulfone polymers and mixtures thereof. Preferred materials that fall within these generic classes include polyethylene, polypropylene, poly(vinylchloride), polymethylmethacrylate (and other acrylic resins), polystyrene, and copolymers thereof (including ABA type block copolymers), poly(vinylidene fluoride), poly(vinylidene chloride), polyvinylalcohol in various degrees of hydrolysis (87% to 99.5%) in crosslinked and non-crosslinked forms. Preferred addition polymers tend to be glassy (a Tg greater than room temperature). This is the case for polyvinylchloride and polymethylmethacrylate, polystyrene polymer compositions or alloys or low in crystallinity for polyvinylidene fluoride and polyvinylalcohol materials.

One class of polyamide condensation polymers are nylon materials. The term "nylon" is a generic name for all long chain synthetic polyamides. Typically, nylon nomenclature includes a series of numbers such as in nylon-6,6 which indicates that the starting materials are a $C_6$ diamine and a $C_6$ diacid (the first digit indicating a $C_6$ diamine and the second digit indicating a $C_6$ dicarboxylic acid compound). Another nylon can be made by the polycondensation of epsilon caprolactam in the presence of a small amount of water. This reaction forms a nylon-6 (made from a cyclic lactam—also known as epsilon-aminocaproic acid) that is a linear polyamide. Further, nylon copolymers are also contemplated. Copolymers can be made by combining various diamine compounds, various diacid compounds and various cyclic lactam structures in a reaction mixture and then forming the nylon with randomly positioned monomeric materials in a polyamide structure. For example, a nylon 6,6-6,10 material is a nylon manufactured from hexamethylene diamine and a $C_6$ and a $C_{10}$ blend of diacids. A nylon 6-6,6-6,10 is a nylon manufactured by copolymerization of epsilonaminocaproic acid, hexamethylene diamine and a blend of a $C_6$ and a $C_{10}$ diacid material.

Block copolymers are also useful in the process of this invention. With such copolymers the choice of solvent swelling agent is important. The selected solvent is such that both blocks were soluble in the solvent. Examples are "ABA" and "AB" type block copolymers where the A and B blocks are soluble in the same solvent. For example, blocks of styrene polymer and blocks of ethylene-butylene random copolymer may be combined into e.g. styrene-b-(ethylene-co-butylene)-b-styrene copolymers or styrene-b-(ethylene-co-butylene) block copolymer structures, wherein both blocks are soluble in, and the block copolymer may therefore be dissolved in, methylene chloride. If one component is not soluble in the solvent, it will form a gel. Examples of such block copolymers are Kraton® type of styrene-b-butadiene and styrene-b-hydrogenated butadiene(ethylene propylene), Pebax® type of ϵ-caprolactam-b-ethylene oxide, Sympatex® polyester-b-ethylene oxide and polyurethanes of polyethylene oxide and isocyanates.

Addition polymers like polyvinylidene fluoride, syndiotactic polystyrene, copolymer of vinylidene fluoride and hexafluoropropylene, polyvinylalcohol, polyvinyl acetate, amorphous addition polymers, such as poly(acrylonitrile) and its copolymers with acrylic acid and methacrylates, polystyrene, poly(vinyl chloride) and its various copolymers, poly (methyl methacrylate) and its various copolymers, can be solution spun with relative ease because they are soluble at low pressures and temperatures. However, highly crystalline polymer like polyethylene and polypropylene require high temperature, high pressure solvent if they are to be solution spun. Therefore, solution spinning of the polyethylene and polypropylene is very difficult. Electrostatic solution spinning is one method of making nanofibers and microfiber.

We have found a substantial advantage to forming polymeric compositions comprising two or more polymeric materials in polymer admixture, alloy format or in a crosslinked chemically bonded structure. We believe such polymer compositions improve physical properties by changing polymer attributes such as improving polymer chain flexibility or chain mobility, increasing overall molecular weight and providing reinforcement through the formation of networks of polymeric materials.

In one embodiment of this concept, two related polymer materials can be blended for beneficial properties. For example, a high molecular weight polyvinylchloride can be blended with a low molecular weight polyvinylchloride. Similarly, a high molecular weight nylon material can be blended with a low molecular weight nylon material. Further, differing species of a general polymeric genus can be blended. For example, a high molecular weight styrene material can be blended with a low molecular weight, high impact polystyrene. A Nylon-6 material can be blended with a nylon copolymer such as a Nylon-6; 6,6; 6,10 copolymer. Further, a polyvinylalcohol having a low degree of hydrolysis such as a 87% hydrolyzed polyvinylalcohol can be blended with a polyvinylalcohol having a degree of hydrolysis between 98 and 99.9% and higher. All of these materials in admixture can be crosslinked using appropriate crosslinking mechanisms. Nylons can be crosslinked using crosslinking agents that are reactive with the nitrogen atom in the amide linkage. Polyvinylalcohol materials can be crosslinked using hydroxyl reactive materials such as monoaldehydes such as formaldehyde, dialdehydes such as glutaraldehyde, ureas, melamine-formaldehyde resin and its analogues, boric acids and other inorganic compounds. diacids, urethanes, epoxies and other known crosslinking agents. Crosslinking technology is a well known and understood phenomenon in which a crosslinking reagent reacts and forms covalent bonds between polymer chains to substantially improve molecular weight, chemical resistance, overall strength and resistance to mechanical degradation. Crosslinking between thermoplastic and thermosetting polymers are not well known.

We have found that additive materials can significantly improve the properties of the polymer materials in the form of a fine fiber. The resistance to the effects of heat, humidity, impact, mechanical stress and other negative environmental effect can be substantially improved by the presence of additive materials. We have found that while processing the microfiber materials of the invention, that the additive materials can improve the oleophobic character, the hydrophobic character and can appear to aid in improving the chemical stability of the materials. We believe that the fine fibers of the invention in the form of a microfiber are improved by the presence of these oleophobic and hydrophobic additives as these additives form a protective layer coating, ablative surface or penetrate the surface to some depth to improve the nature of the polymeric material. We believe the important characteristics of these materials are the presence of a strongly hydrophobic group that can preferably also have oleophobic character, such as fluorocarbon groups, hydrophobic hydrocarbon surfactants or blocks and substantially hydrocarbon oligomeric compositions. These materials are manufactured in compositions that have a portion of the molecule that tends to be compatible with the polymer material affording typically a physical bond or association with the polymer while the strongly hydrophobic or oleophobic group, as a result of the association of the additive with the polymer, forms a protective surface layer that resides on the surface or becomes alloyed with or mixed with the polymer surface layers. For 0.2-micron fiber with 10% additive level, the surface thickness is calculated to be around 50 Å, if the additive has migrated toward the surface. Migration is believed to occur due to the incompatible nature of the oleophobic or hydrophobic groups in the bulk material. A 50 Å thickness appears to be reasonable thickness for protective coating. For 0.05-micron diameter fiber, 50 Å thickness corresponds to 20% mass. For 2 microns thickness fiber, 50 Å thickness corresponds to 2% mass. Preferably the additive materials are used at an amount of about 2 to 25 wt. %. Oligomeric additives that can be used in combination with the polymer materials of the invention include oligomers having a molecular weight of about 500 to about 5000, preferably about 500 to about 3000 including fluoro-chemicals, nonionic surfactants and low molecular weight resins or oligomers. Examples of useful phenolic additive materials include Enzo-BPA, Enzo-BPA/phenol, Enzo-TBP, Enzo-COP and other related phenolics were obtained from Enzymol International Inc., Columbus, Ohio.

An extremely wide variety of fibrous filter media exist for different applications. The durable nanofibers and microfibers described in this invention can be added to any of the media. The fibers described in this invention can also be used to substitute for fiber components of these existing media giving the significant advantage of improved performance (improved efficiency and/or reduced pressure drop) due to their small diameter, while exhibiting greater durability.

Polymer nanofibers and microfibers are known, however their use has been very limited due to their fragility to mechanical stresses, and their susceptibility to chemical degradation due to their very high surface area to volume ratio. The fibers described in this invention address these limitations and will therefore be usable in a very wide variety of filtration, textile, membrane and other diverse applications.

A filter media construction according to the present invention includes a support layer of permeable coarse fibrous media or substrate having a first surface. A layer of fine fiber media is secured to a surface of the support or substitute layer of permeable coarse fibrous media. Preferably the layer of permeable coarse fibrous material comprises fibers having an average diameter of at least 10 microns, typically and preferably about 12 (or 14) to 30 microns. Also preferably the first layer of permeable coarse fibrous material comprises a media having a basis weight of no greater than about 200 grams/meter$^2$, preferably about 0.50 to 150 g/m$^2$, and most preferably at least 8 g/m$^2$. Preferably the first layer of permeable coarse fibrous media is at least 0.0005 inch (12 microns) thick, and typically and preferably is about 0.001 to 0.030 inch (25-800 microns) thick.

In preferred arrangements, the layer of permeable coarse fibrous material comprises a material which, if evaluated separately from a remainder of the construction by the Frazier permeability test, would exhibit a permeability of at least 1 meter(s)/min, and typically and preferably about 2-900 meters/min. Herein when reference is made to efficiency, unless otherwise specified, reference is meant to efficiency when measured according to ASTM-1215-89, with 0.78μ monodisperse polystyrene spherical particles, at 20 fpm (6.1 meters/min) as described herein.

Preferably the layer of fine fiber material secured to the surface of the support or substitute layer of permeable coarse fibrous media is a layer of nano- and microfiber media wherein the fibers have average fiber diameters of no greater than about 2 microns, generally and preferably no greater than about 1 micron, and typically and preferably have fiber diameters smaller than 0.5 micron and within the range of about 0.05 to 0.5 micron. Also, preferably the first layer of fine fiber material secured to the first surface of the first layer of permeable coarse fibrous material has an overall thickness that is no greater than about 30 microns, more preferably no more than 20 microns, most preferably no greater than about 10 microns, and typically and preferably that is within a thickness of about 1-8 times (and more preferably no more than 5 times) the fine fiber average diameter of the layer.

Fiber can be made by conventional methods and can be made by e.g. melt spinning the thermoplastic polyurethane or a mixed polyether urethane and an additive. Melt spinning is a well known process in which a polymer is melted by extrusion, passed through a spinning nozzle into air, solidified by cooling, and collected by winding the fibers on a collection device. Typically the fibers are melt spun at a polymer temperature of about 150° C. to about 300° C.

The microfiber or nanofiber of the unit can also be formed by the electrostatic spinning process. A suitable apparatus for forming the fiber is illustrated in Barris, U.S. Pat. No. 4,650,506. This apparatus includes a reservoir in which the fine fiber forming polymer solution is contained, a pump and a rotary type emitting device or emitter to which the polymeric solution is pumped. The emitter generally consists of a rotating union, a rotating portion including a plurality of offset holes and a shaft connecting the forward facing portion and the rotating union. The rotating union provides for introduction of the polymer solution to the forward facing portion through the hollow shaft. Alternatively, the rotating portion can be immersed into a reservoir of polymer fed by reservoir and pump. The rotating portion then obtains polymer solution from the reservoir and as it rotates in the electrostatic field, a droplet of the solution is accelerated by the electrostatic field toward the collecting media as discussed below.

Facing the emitter, but spaced apart there from, is a substantially planar grid upon which the collecting media (i.e. substrate or combined substrate) is positioned. Air can be drawn through the grid. The collecting media is passed around rollers which are positioned adjacent opposite ends of the grid. A high voltage electrostatic potential is maintained between emitter and grid by means of a suitable electrostatic voltage source and connections and which connect respectively to the grid and emitter.

In use, the polymer solution is pumped to the rotating union or reservoir from reservoir. The forward facing portion rotates while liquid exits from holes, or is picked up from a reservoir, and moves from the outer edge of the emitter toward collecting media positioned on the grid. Specifically, the electrostatic potential between grid and the emitter imparts a charge to the material which cause liquid to be emitted therefrom as thin fibers which are drawn toward grid where they arrive and are collected on substrate or an efficiency layer. In the case of the polymer in solution, solvent is evaporated off the fibers during their flight to the grid; therefore, the fibers arrive at the substrate or efficiency layer. The fine fibers bond to the substrate fibers first encountered at the grid. Electrostatic field strength is selected to ensure that the polymer material as it is accelerated from the emitter to the collecting media, the acceleration is sufficient to render the material into a very thin microfiber or nanofiber structure. Increasing or slowing the advance rate of the collecting media can deposit more or less emitted fibers on the forming media, thereby allowing control of the thickness of each layer deposited thereon. The rotating portion can have a variety of beneficial positions. The rotating portion can be placed in a plane of rotation such that the plane is perpendicular to the surface of the collecting media or positioned at any arbitrary angle. The rotating media can be positioned parallel to or slightly offset from parallel orientation.

To form the fiber network on a substrate, a sheet-like substrate is unwound at a station. The sheet-like substrate is then directed to a splicing station wherein multiple lengths of the substrate can be spliced for continuous operation. The continuous length of sheet-like substrate is directed to a fine fiber technology station comprising the spinning technology discussed above, wherein a spinning device forms the fine fiber and lays the fine fiber in a filtering layer on the sheet-like substrate. After the fine fiber layer is formed on the sheet-like substrate in the formation zone, the fine fiber layer and substrate are directed to a heat treatment station for appropriate processing. The sheet-like substrate and fine fiber layer is then tested in an efficiency monitor and nipped if necessary at a nip station. The sheet-like substrate and fiber layer is then steered to the appropriate winding station to be wound onto the appropriate spindle for further processing.

EXAMPLE 1

A thermoplastic aliphatic polyurethane compound manufactured by Noveon®, TECOPHILIC SP-80A-150 TPU was used. The polymer is a polyether polyurethane made by reacting dicyclohexylmethane 4,4'-diisocyanate with a polyol. This polymer is referred to hereinafter as Polymer 1.

EXAMPLE 2

A copolymer of nylon 6, 66, 610 nylon copolymer resin (SVP-651) was analyzed for molecular weight by the end group titration. (J. E. Walz and G. B. Taylor, determination of the molecular weight of nylon, Anal. Chem. Vol. 19, Number 7, pp 448-450 (1947). Number average molecular weight was between 21,500 and 24,800. The composition was estimated by the phase diagram of melt temperature of three component nylon, nylon 6 about 45%, nylon 66 about 20% and nylon 610 about 25%. (Page 286, Nylon Plastics Handbook, Melvin Kohan ed. Hanser Publisher, New York (1995)). Reported physical properties of SVP 651 resin are:

| Property | ASTM Method | Units | Typical Value |
|---|---|---|---|
| Specific Gravity | D-792 | — | 1.08 |
| Water Absorption (24 hr immersion) | D-570 | % | 2.5 |
| Hardness | D-240 | Shore D | 65 |
| Melting Point | DSC | ° C.(° F.) | 154 (309) |
| Tensile Strength @ Yield | D-638 | MPa (kpsi) | 50 (7.3) |

-continued

| Property | ASTM Method | Units | Typical Value |
|---|---|---|---|
| Elongation at Break | D-638 | % | 350 |
| Flexural Modulus | D-790 | MPa (kpsi) | 180 (26) |
| Volume Resistivity | D-257 | ohm-cm | $10^{12}$ |

This polymer is referred to hereinafter as Polymer 2.

EXAMPLE 3

Polymer 1 was mixed with phenolic resin, identified as Georgia Pacific 5137. The Polymer 1:Phenolic Resin ratio and its melt temperature of blends are shown here:

| Composition | Melting Temperature (F. °) |
|---|---|
| Polymer 1:Phenolic = 100:0 | 150 |
| Polymer 1:Phenolic = 80:20 | 110 |
| Polymer 1:Phenolic = 65:35 | 94 |
| Polymer 1:Phenolic = 50:50 | 65 |

The elasticity benefit of this new fiber chemistry comes from the blend of a polymer with a polyurethane.

EXAMPLE 4

Polymer 1 was dissolved in ethyl alcohol at 60° C. by rigorously stirring for 4 hours. After the end of 4 hours, the solution was cooled to room temperature. The solids content of the solution was around 13 wt %, although different amounts of polymer solids can be used. Upon cooling to room temperature, the viscosity of the solution was measured at 25° C. and was found to be about 340 cP.

Figure 2:
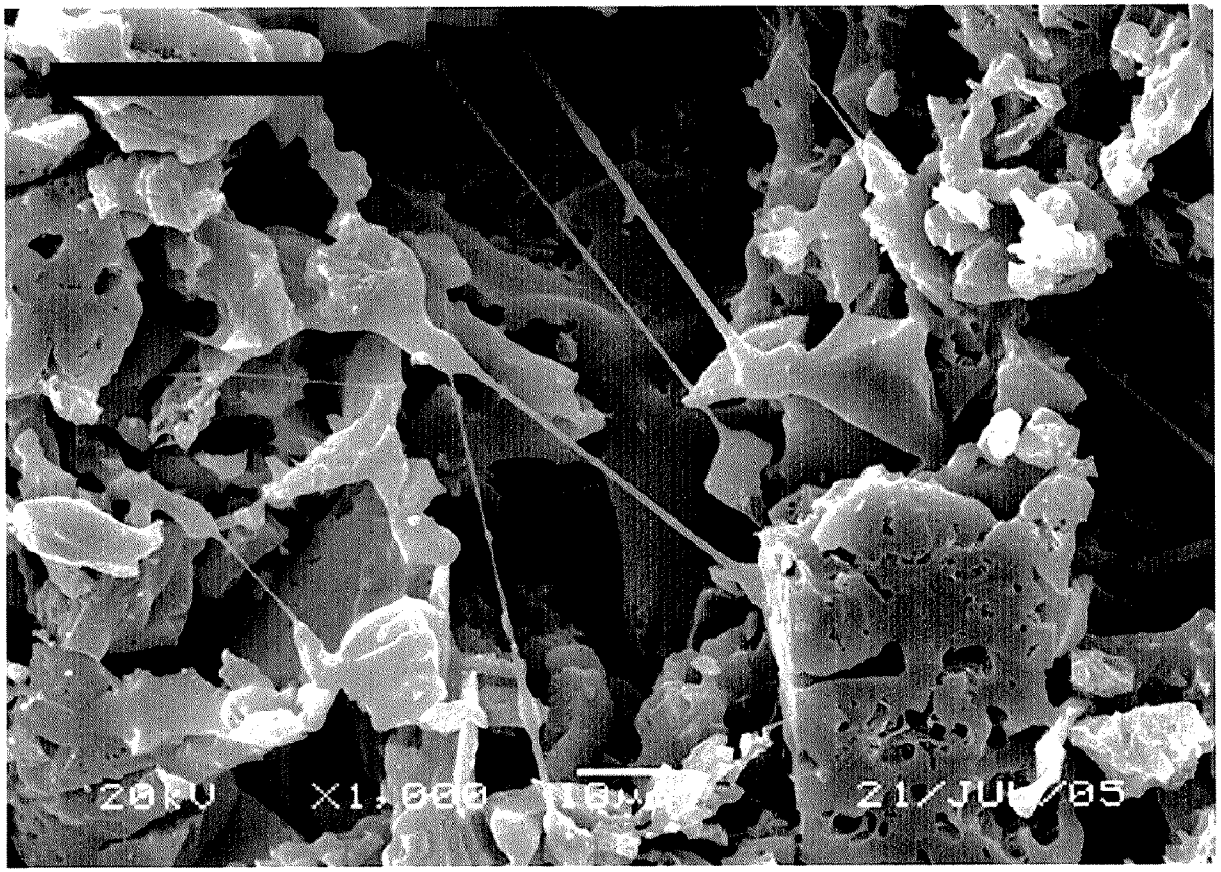

This solution was electrospun onto a coarse fiber support layer, which was Reemay® polyester nonwoven (available from Fiberweb plc of Old Hickory, Tenn.) employing various conditions. After spinning, carbon particles were adhered to the web due to the tacky characteristics of the fibers. The carbon particles used were activated carbon, 325 mesh (available from the Calgon Carbon Company of Pittsburgh, Pa.). Scanning Electron Microscope (SEM) images show the fiber assembly 10 having electrospun fibers 11 and carbon particles 12 entrained in the fibers 11 in FIG. 1, and the same composite after heating at 99° C. for 5 minutes in FIG. 2. FIG. 2 shows that the fibers 11 of FIG. 1 melted, indicating poor temperature resistance and lack of suitability for a filter that is subjected to elevated temperatures.

While this polyurethane has excellent elasticity, it is rather preferred to have temperature resistance as well. This is particularly important if there are subsequent downstream processes that require high temperature processing. One example can be given in the field of chemical filtration. The particles 12 displayed in FIG. 1 are activated carbon particles intended for removal of certain chemicals in the gas phase. The adsorption capacity of these particles has a strong relationship with their post-process conditions. In electrospinning, the solvent vaporizing from the electrospun fibers as they form and dry can be adsorbed by the carbon particles, thereby limiting overall capacity of the particles to adsorb materials in the intended end use. In order to "flush" the solvent molecules from the activated carbon particles, it is therefore necessary to heat the formed filter structure at a temperature beyond the boiling point of solvent, in this case 78-79° C., for an extended duration of time to remove residual solvent from the carbon particles. Consequently, these fibers must withstand the temperatures used in the post-treatment process in order to be useful as chemical filter applications employing activated carbon particles.

EXAMPLE 5

To solve the temperature resistance problem of these fibers and at the same time to benefit from their high elasticity and tackiness (desired for attachment of active and/or non-active particles etc.), we made electrospun fibers of a blend of Polymer 1 and Polymer 2. Thus, 13 wt % Polymer 1 and 12 wt % Polymer 2 were individually dissolved in ethyl alcohol. The two polymers were then blended at several different ratios, thereby providing a range of solution viscosities. In this example we used 13:12 wt % of Polymer 1:Polymer 2.

Figure 3:
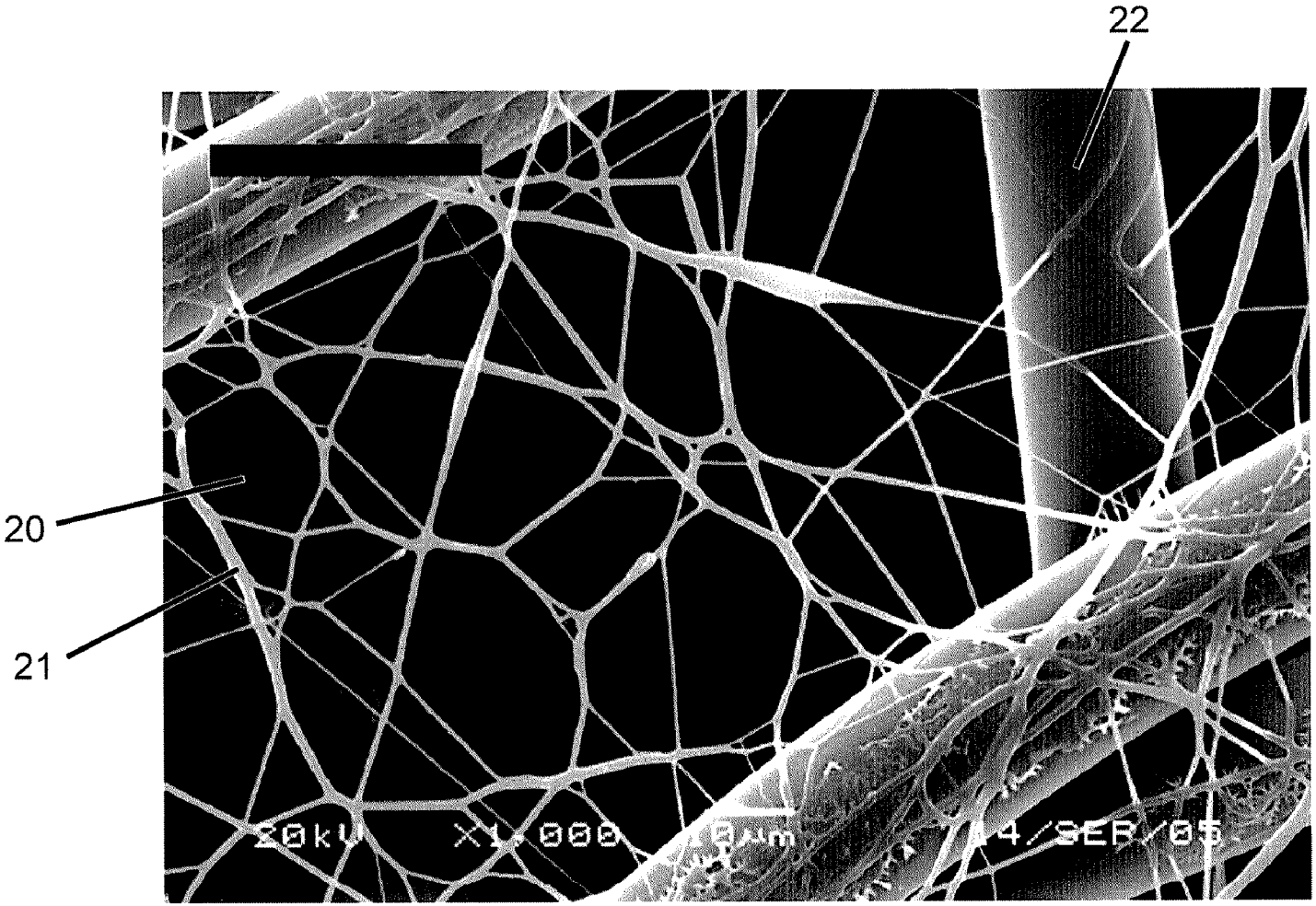
FIGS. 3 and 4 show a fine fiber web comprising the blended polymer materials of the invention.
Figure 4:
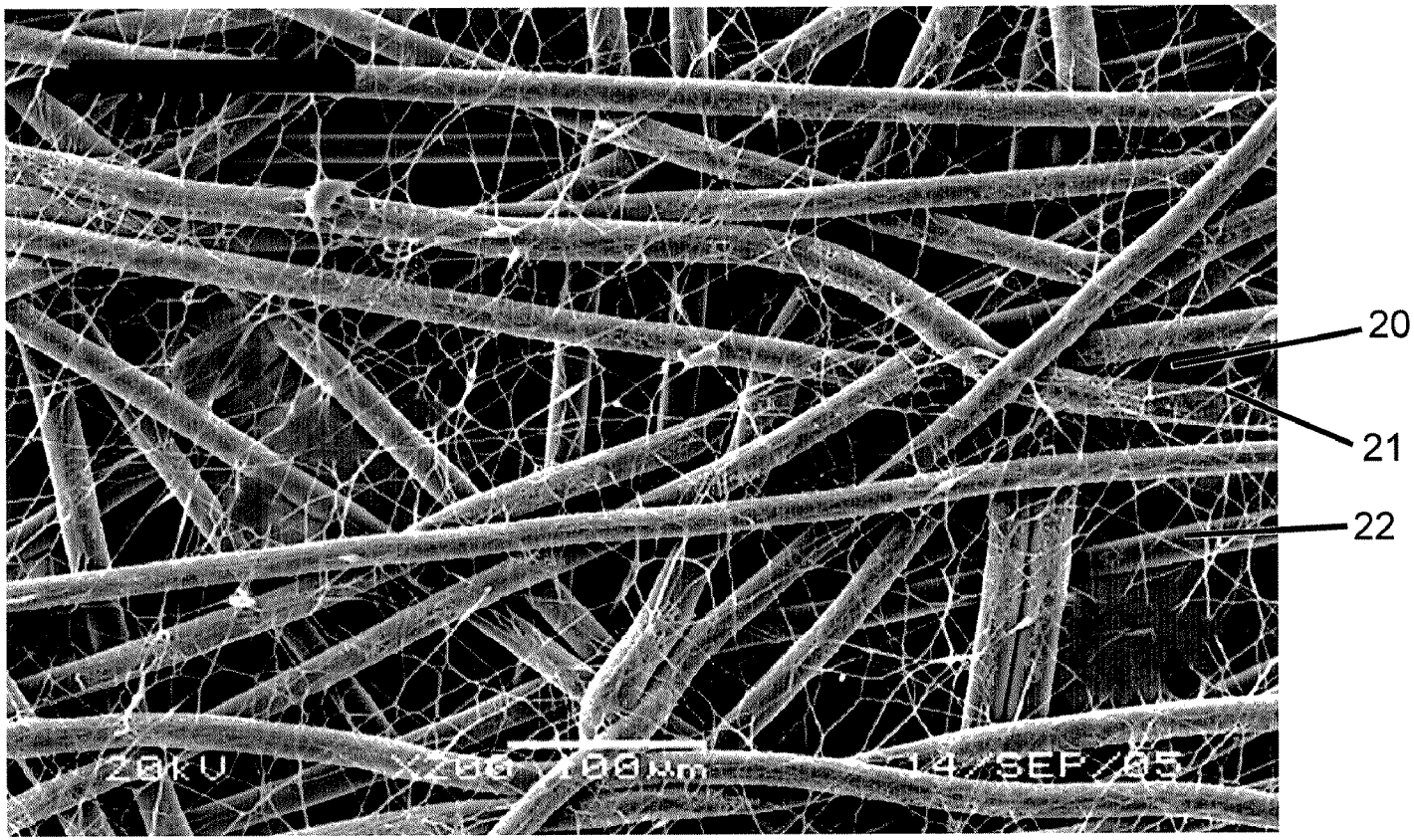
Figure 5:
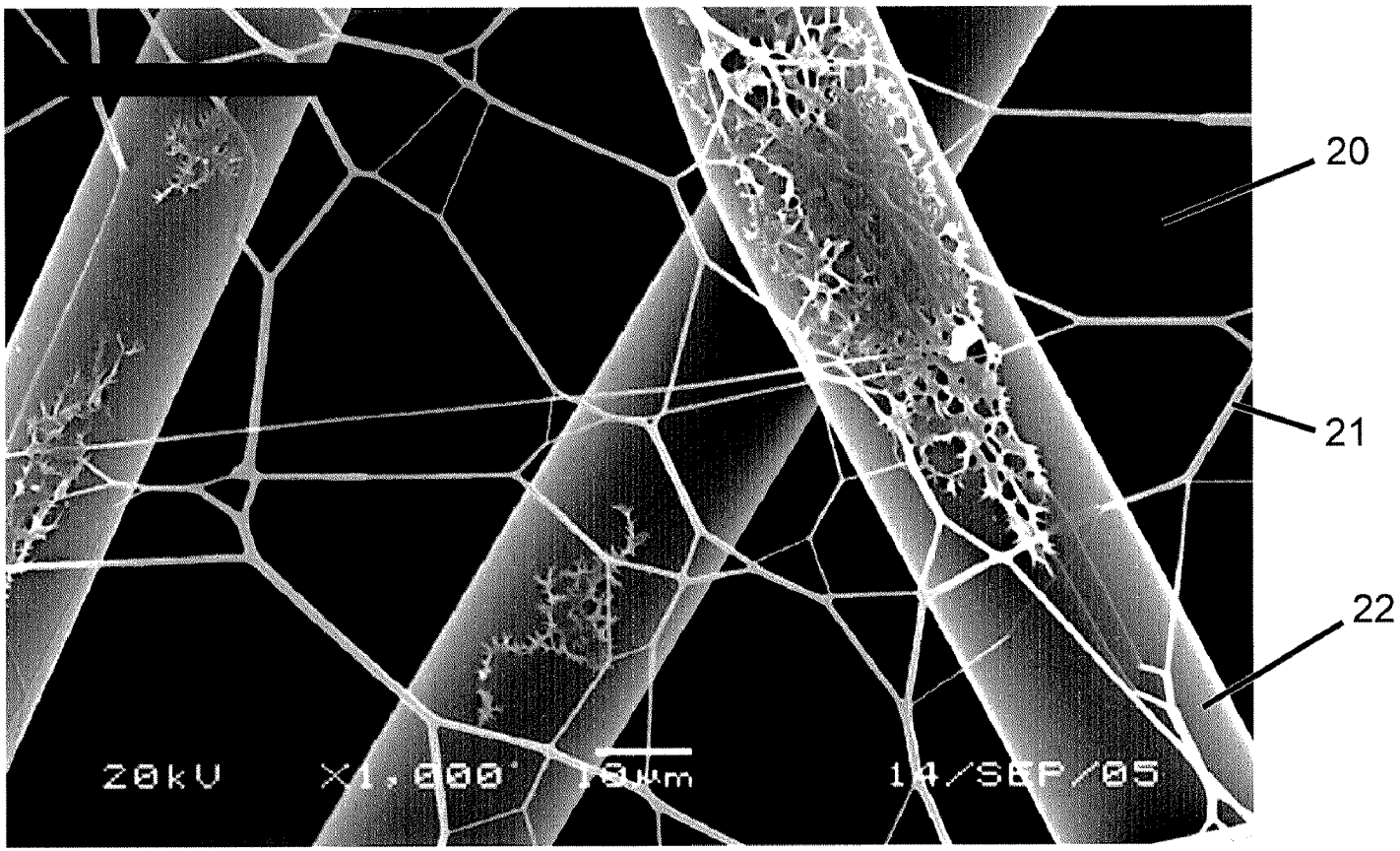
FIGS. 5 and 6 show the fine fiber web of FIGS. 4 and 5 after heating.
Figure 6:
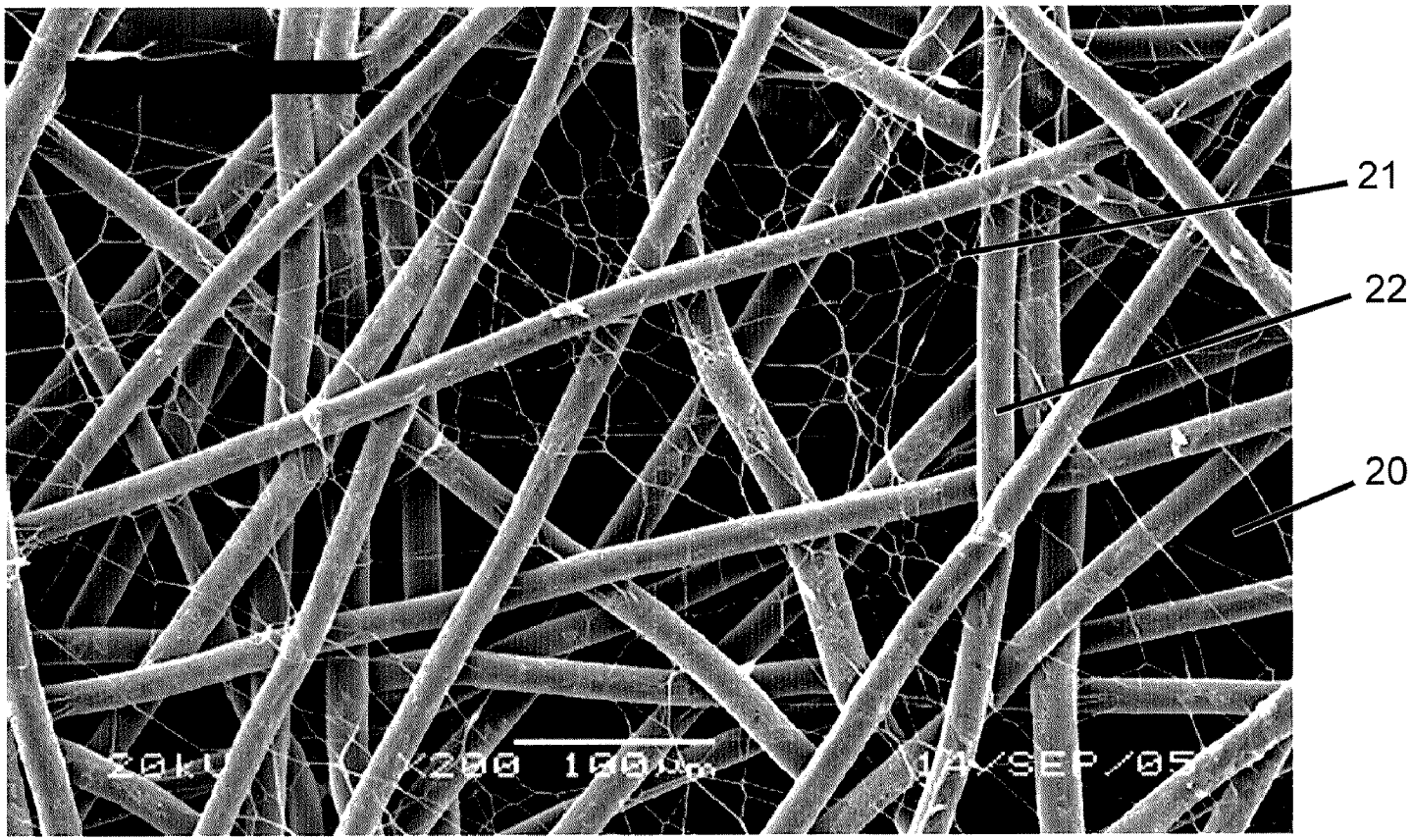

This solution had a viscosity of about 210 cP. The mixing was carried out in room temperature by simply stirring the blend of the two polymer solutions vigorously for several minutes. Electro spinning of the blend was carried out using the same techniques discussed in Example 4. SEM images of the electrospun webs depict the fiber assembly 20 having the electrospun fibers 21 on the coarse fibers 22 at 1000× in FIG. 3 and the same assembly 20 at 200× in FIG. 4. The fibers were then subjected to heating at 110° C. for 2 minutes. The fiber assembly 20 is shown after the heating step at 1000× in FIG. 5 and at 200× in FIG. 6. It can be observed that fine fibers 21 on coarse fibers 22 are intact after the heating step.

Thus, the fibers electrospun from the 13:12 wt % blend of Polymer 1:Polymer 2 have excellent temperature stability and thus remain intact after the heating step. The polymers also have good elasticity and tackiness. This combination of properties cannot be found in either component alone. The fibers have an average diameter about two to three times that of the average fiber diameter of Polymer 2 fibers (Polymer 2 average fiber diameter is in the range of 0.25 microns).

EXAMPLE 6

Fibers having either Polymer 1 or Polymer 2 alone were electrospun using the same technique as described above. These single component fibers as well as the fibers comprising 13:12 wt % of Polymer 1:Polymer 2 as described in Example 5 above were subjected to thermogravimetric analysis using differential scanning calorimetry (DSC). The results of the scan are shown in FIG. 7.

Figure 7:
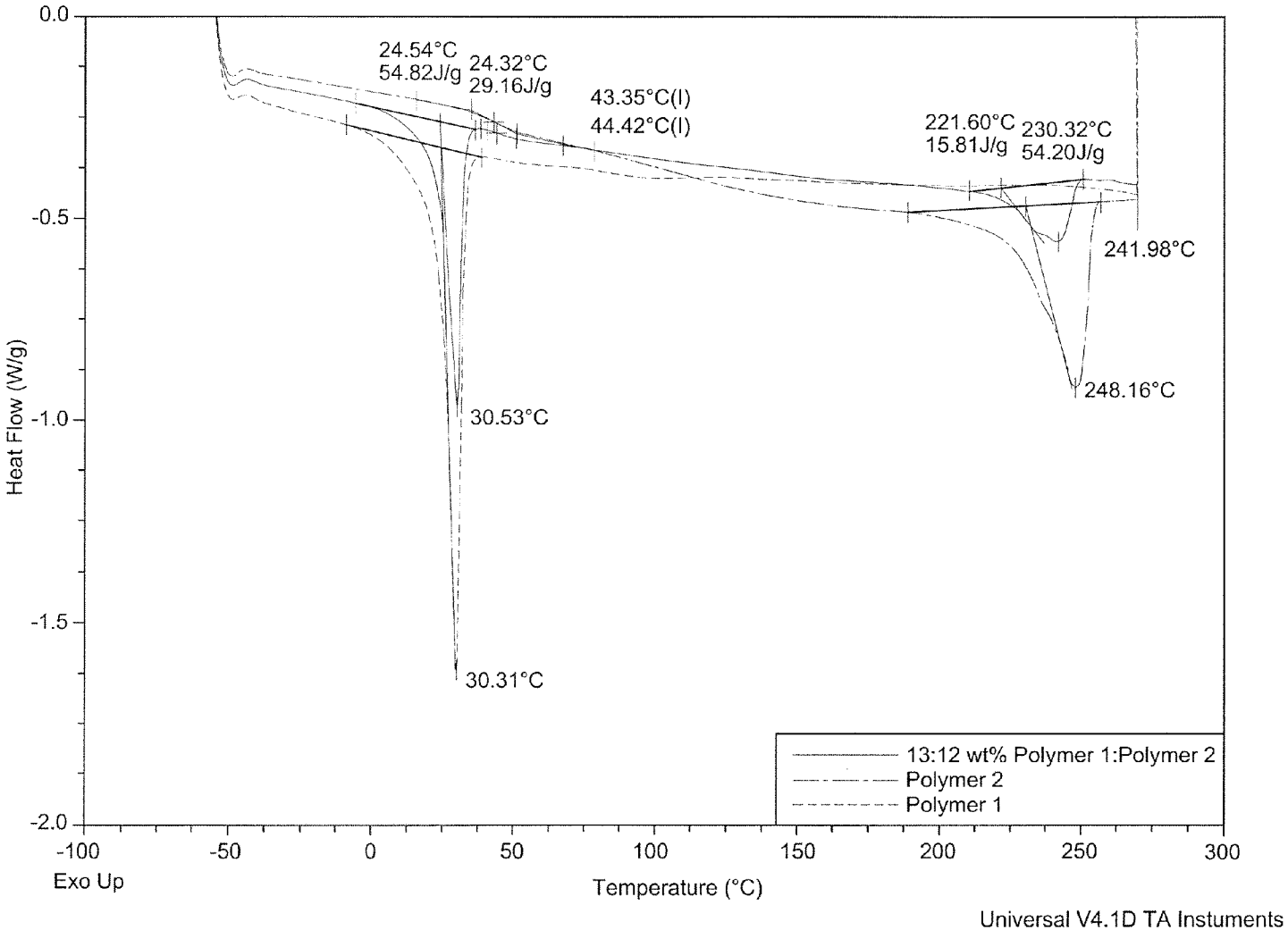
FIG. 7 is a DSC scan that shows the thermal properties of two homopolymers and their polymer alloy, which was used to electrospin the fine fibers of the invention.

In inspecting FIG. 7 it can be observed that the polymer blend has the melt and glass transition characteristics of both components. Thus, the blend has a melt transition at about 30° C. that corresponds to the polyurethane component (Polymer 1), a glass transition temperature of approximately 44° C. that corresponds to the nylon component (Polymer 2) and a melt transition at about 242° C. corresponding to the melt temperature of Polymer 2. FIG. 7 shows why excellent thermal resistance was observed in the filter structures made from the blend: because the fibers are a blend of nylon and polyurethane, the fibers do not fully melt below the melt temperature of the nylon component.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A layered structure comprising a fine fiber layer and a filtration support, the fine fiber comprising a first polymer and a second polymer, the first polymer comprising an aliphatic polyurethane comprising the reaction product of an aliphatic diisocyanate and either an aliphatic polyether polyol or an aliphatic polyester polyol and a second polymer comprising a polyamide polymer comprising a nylon 6, a nylon 66, a nylon 610 or mixtures thereof, or co-polymers thereof; wherein there are about 0.1 to about 0.99 parts of the second polymer per part of the first polymer, and the fiber has a diameter of about 0.001 to about 2 microns.

2. The layered structure of claim 1 wherein the aliphatic diisocyanate comprises dicyclohexylmethane-4,4'-diisocyanate.

3. The layered structure of claim 1 wherein the polyol consists of a polyether polyol.

4. The layered structure of claim 1 wherein the polyurethane comprises a hard aliphatic diisocyanate section and a soft polyol section.

5. The layered structure of claim 1 combined with a particulate.

6. The layered structure of claim 5 wherein the filtration support is a non-woven filtration support.

7. The layered structure of claim 5 wherein the non-woven filtration support comprises a cellulosic medium, a cellulose synthetic medium or a polymeric synthetic medium.

8. The layered structure of claim 7 wherein the fine fiber is in the form of a non-woven layer having a thickness of about 1 to about 300 microns.

9. The layered structure of claim 1 wherein the fiber is electrospun onto a filtration support layer to form an electrospun fiber layer.

10. The layered structure of claim 1 wherein the filtration support layer is a nonwoven web.

11. The layered structure of claim 1 wherein the filtration support layer comprises a cellulosic filtration support, a cellulosic/synthetic filtration support or a polymeric non woven filtration support.

12. The layered structure of claim 1 wherein the fiber layer is removed from the filtration support layer after electrospinning.

13. The layered structure of claim 1 wherein the fine fiber diameter is about 0.01 to about 2 microns and the thickness of the layer is about 1 to 100 times the diameter of the fine fiber.

14. The layered structure of claim 1 wherein the fiber layer thickness is about 1 to 5 times the diameter of the fine fiber.

15. The layered structure of claim 1 wherein the fiber layer thickness is about 1 to 30 microns.

16. The layered structure of claim 1 wherein the fiber layer is a bilayer of the fine fiber.

17. The layered structure of claim 1 wherein the layer is a multilayer of the fine fiber.

* * * * *